US006755687B1

(12) United States Patent
Ko

(10) Patent No.: US 6,755,687 B1
(45) Date of Patent: Jun. 29, 2004

(54) MICRO COAXIAL CABLE CONNECTOR ASSEMBLY WITH IMPROVED CONTACTS

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/687,419

(22) Filed: Oct. 15, 2003

(51) Int. Cl.[7] ..... H01R 13/648
(52) U.S. Cl. ..... 439/579; 439/610
(58) Field of Search ..... 439/579, 610, 439/497, 874

(56) References Cited

U.S. PATENT DOCUMENTS 6,123,582 A 9/2000 Ko et al.
6,544,050 B1 * 4/2003 Ko ..... 439/108
6,619,985 B1 * 9/2003 Ko ..... 439/607
6,655,992 B1 * 12/2003 Ko ..... 439/579
6,676,444 B2 * 1/2004 Noro ..... 439/579

* cited by examiner

*Primary Examiner*—Gary Paumen
(74) *Attorney, Agent, or Firm*—Wei Te Chung

(57) ABSTRACT

A cable connector assembly (1) includes an insulative housing (2), a number of contacts (3), a number of wires (5), a number of solder slugs (8) and a grounding member (6). The housing includes a mating portion (21) defining a receiving cavity (22) opening in a first direction, and a base (20) perpendicular to the mating portion and defining a number of canals (222). Each contact includes a pair of contacting portions (30) and a soldering portion (32) received in the canal and forming an extrusion (320) exposed beyond the canal. The solder slugs are received in the canals. The grounding member includes a first grounding shield (60) assembled to the mating portion in the first direction and a second grounding shield (62) assembled to the base in the second direction. The solder slugs melt upon heating the extrusions of the soldering portions to solder the contacts with the wires.

15 Claims, 7 Drawing Sheets

MICRO COAXIAL CABLE CONNECTOR ASSEMBLY WITH IMPROVED CONTACTS

BACKGROUND OF THE INVENTION

1. Field of the Invention

The present invention generally relates;to a cable connector assembly, and more particularly to a micro coaxial cable connector assembly with improved contact structure.

2. Description of Related Art

U.S. Pat. No. 6,123,582 discloses a micro coaxial cable connector assembly used for mating with a complementary connector to connect a Liquid Crystal Display (LCD) with a main board of a notebook on which the complementary connector is horizontally mounted. The cable connector assembly comprises a first and a second housing members, a cable with a plurality of wires, an upper and a lower shield members, and a plurality of contacts. Each wire has a central signal conductor and a grounding braiding around the signal conductor. A grounding bar is soldered to the grounding braiding of the wires. The upper and the lower shield members attached onto the first housing member are engagingly jointed with each other and electrically contact with a shield member of the complementary connector. Meanwhile, the upper shield member further forms a plurality of spring fingers extending inside the first housing member to electrically engage with the grounding bar. Therefore, a grounding path from the wires to the complementary connector is established. However, in some applications, there is a need to having a micro coaxial cable connector assembly mating with a vertically mounted complementary header connector in a vertical direction.

Hence, an improved micro coaxial cable connector assembly is highly desired to overcome the disadvantages of the prior art.

SUMMARY OF THE INVENTION

Accordingly, an object of the present invention is to provide an improved micro coaxial cable connector assembly mating with a header vertically mounted on a printed circuit board, in which the cable connector assembly has improved contacts to achieve good electrical connection with wires.

In order to achieve the object set forth, a cable connector assembly in accordance with the present invention comprises an insulative housing, a plurality of conductive contacts, a plurality of wires, a plurality of solder slugs and a grounding member. The housing comprises a mating portion defining a receiving cavity in a first direction, and a base perpendicular to the mating portion and defining a plurality of canals. Each contact comprises a pair of contacting portions received in the mating portion and a soldering portion connecting with the contacting portions and received in the canal. The soldering portion, forms an extrusion exposed beyond the canal. Each wire comprises a pair of conductors extending into corresponding canals in a second direction perpendicular to the first direction and a metal braiding surrounding the conductors. The solder slugs are received in the canals and respectively located between the soldering portions and the conductors. The grounding member comprises a first grounding shield assembled to the mating portion in the first direction and a second grounding shield assembled to the base in the second direction. The first and the second grounding shields electrically connect with each other and electrically connect with the metal braiding of the wires. The solder slugs melt upon heating the extrusions of the soldering portions to solder the contacts with the wires.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
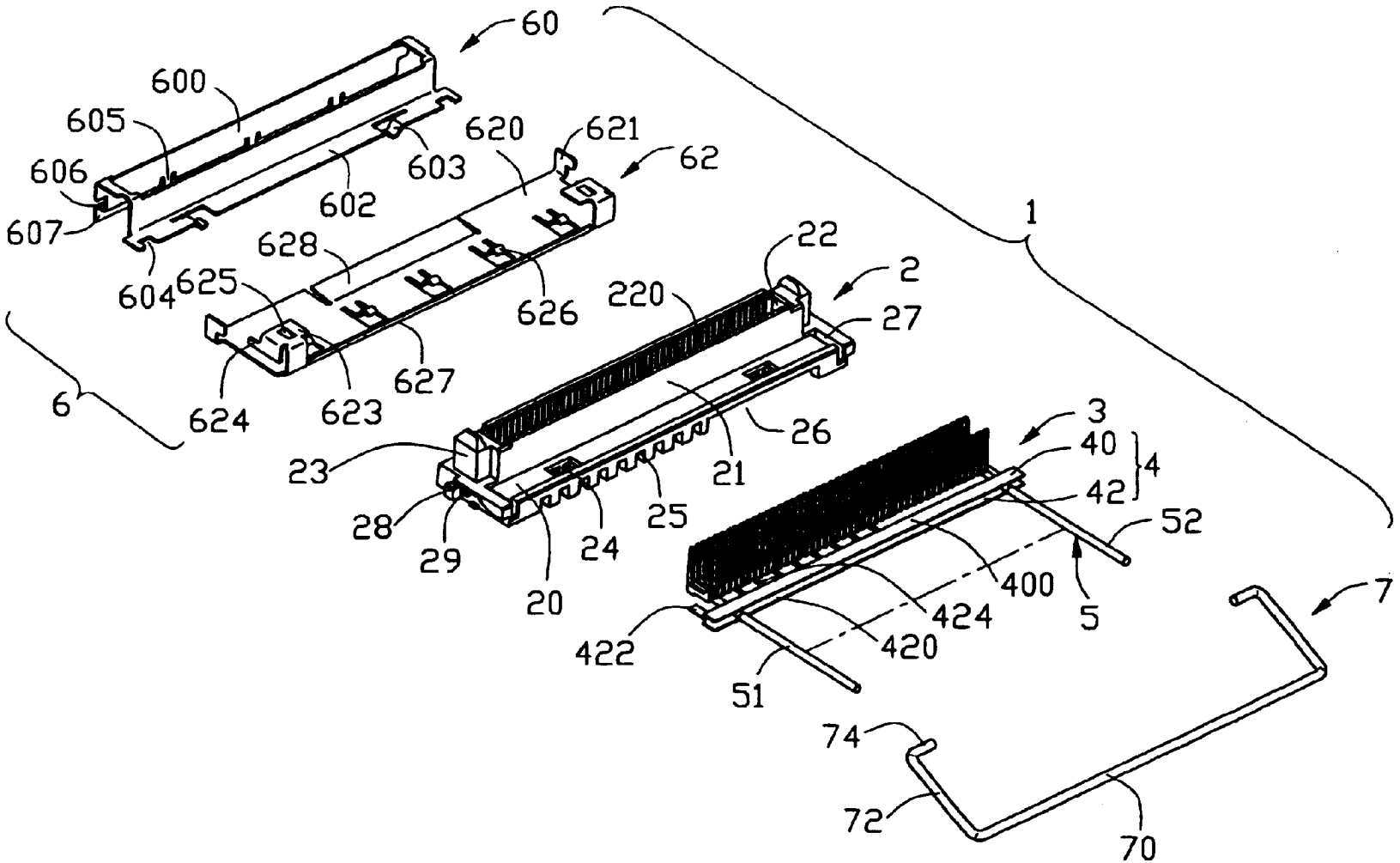
FIG. 1 is a partially exploded, perspective view of a cable connector assembly in accordance with the present invention.
Figure 2:
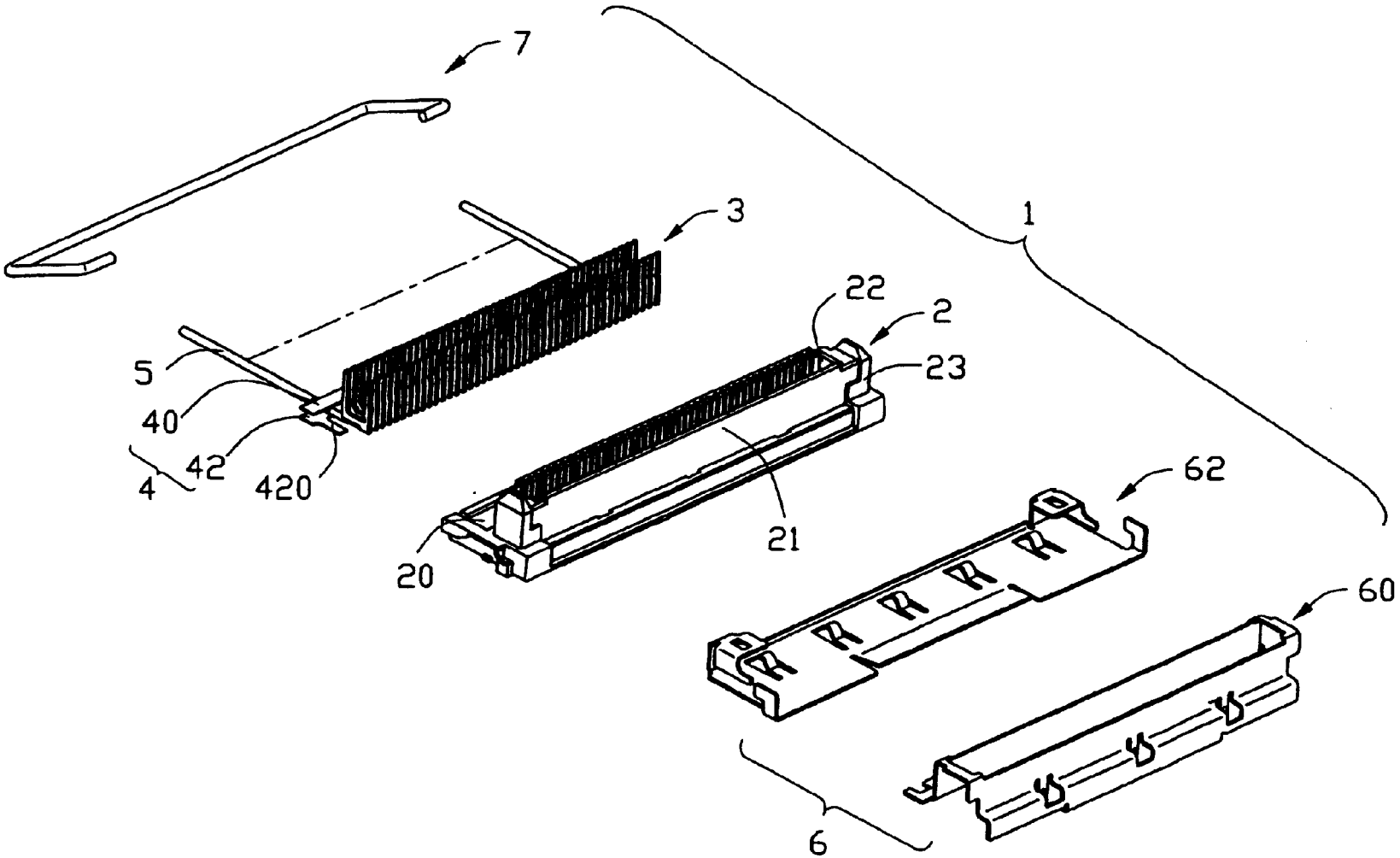
FIG. 2 is a view similar to FIG. 1, but taken from a different aspect.
Figure 3:
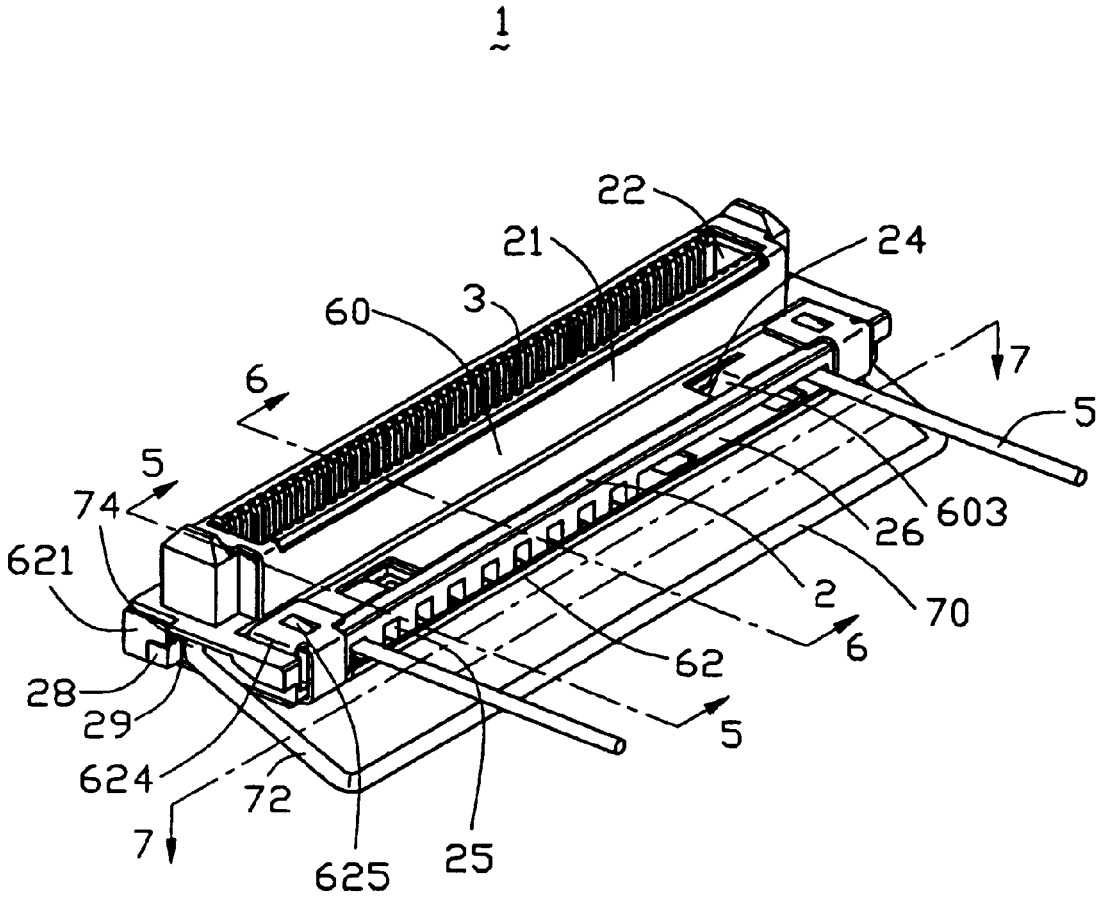
FIG. 3 is an assembled view of FIG. 1.
Figure 4:
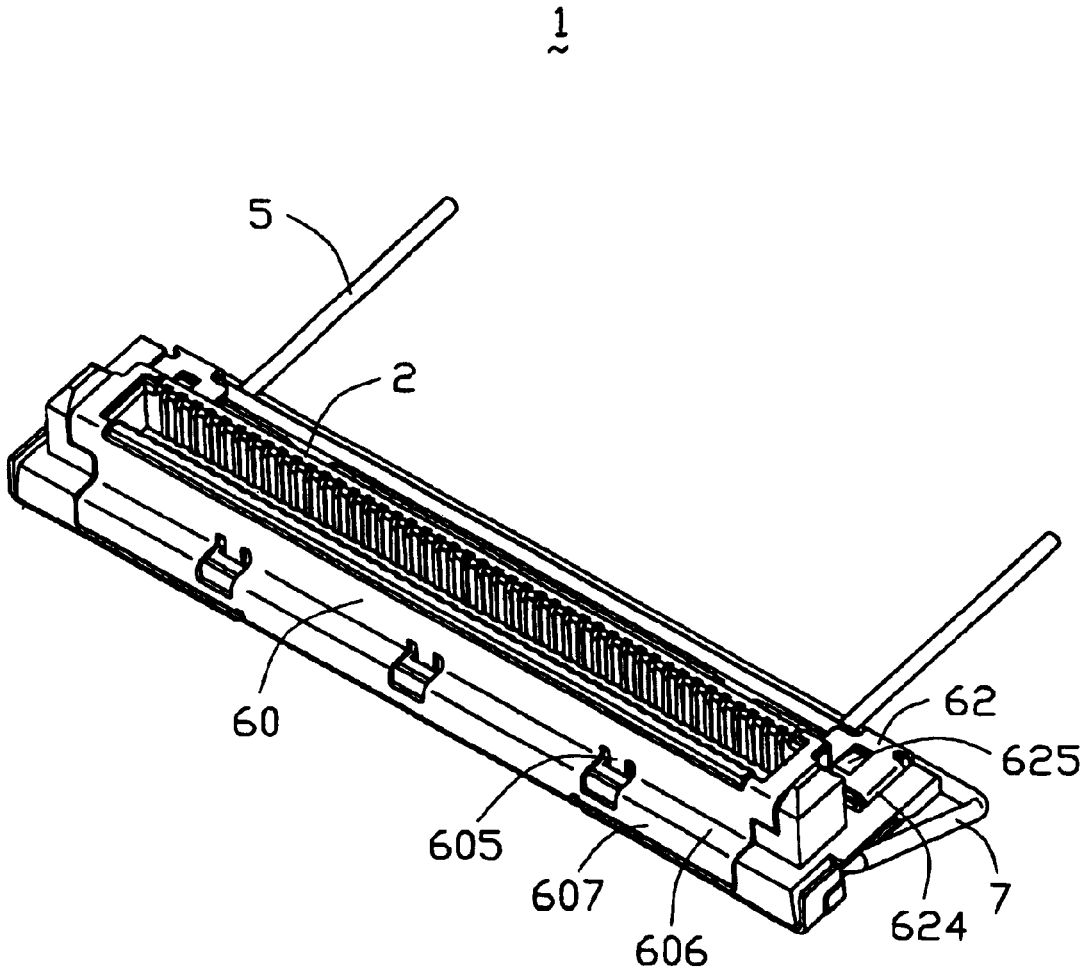
FIG. 4 is a view similar to FIG. 3, but taken from a different aspect.
Figure 5:
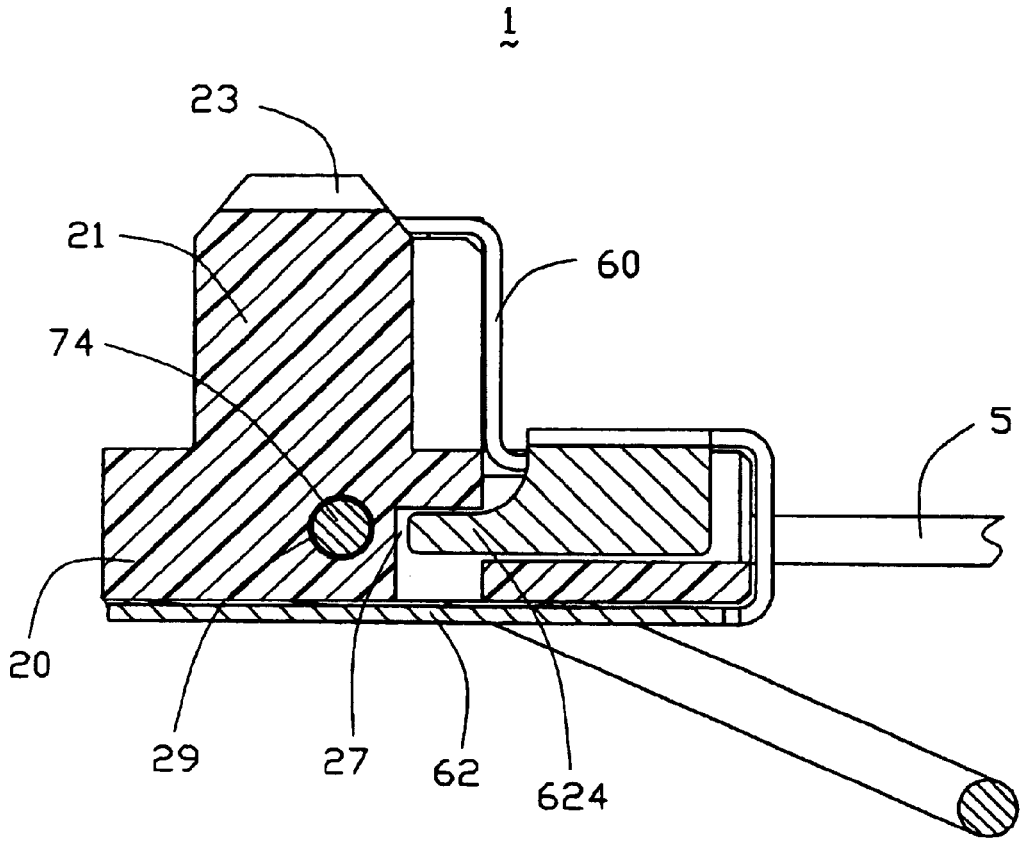
FIG. 5 is a cross-sectional view of the cable connector assembly of FIG. 3 taken along line 5—5.

Referring to FIG. 1 and FIG. 2, a cable connector assembly 1 in accordance with the present invention comprises an insulative housing 2, a plurality of conductive contacts 3 assembled to the insulative housing 2, a grounding bar 4, a cable 5 electrically connected with the conductive contacts 3, a grounding member 6 assembled to the insulative housing 1, and a pulling member 7.

Figure 6:
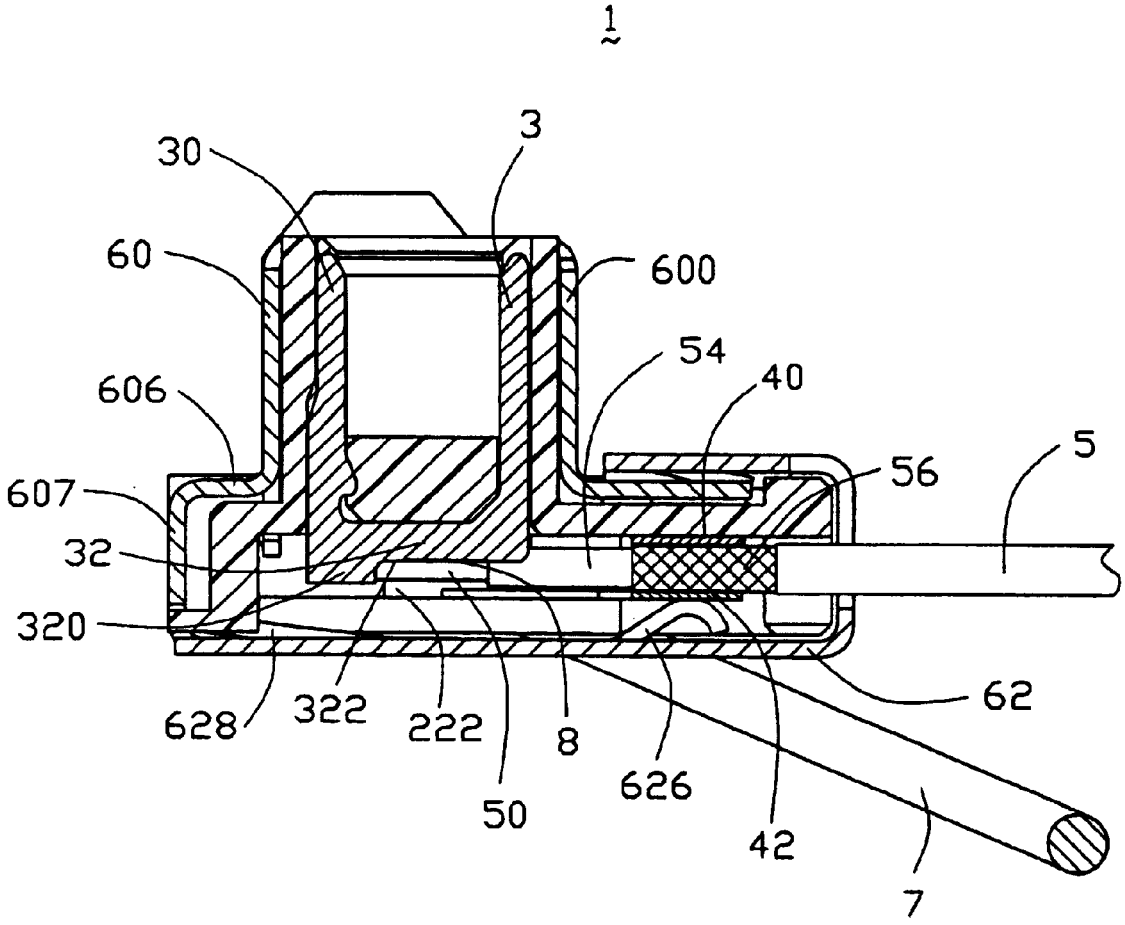
FIG. 6 is a cross-sectional view of the cable connector assembly of FIG. 3 taken along line 6—6.
Figure 7:
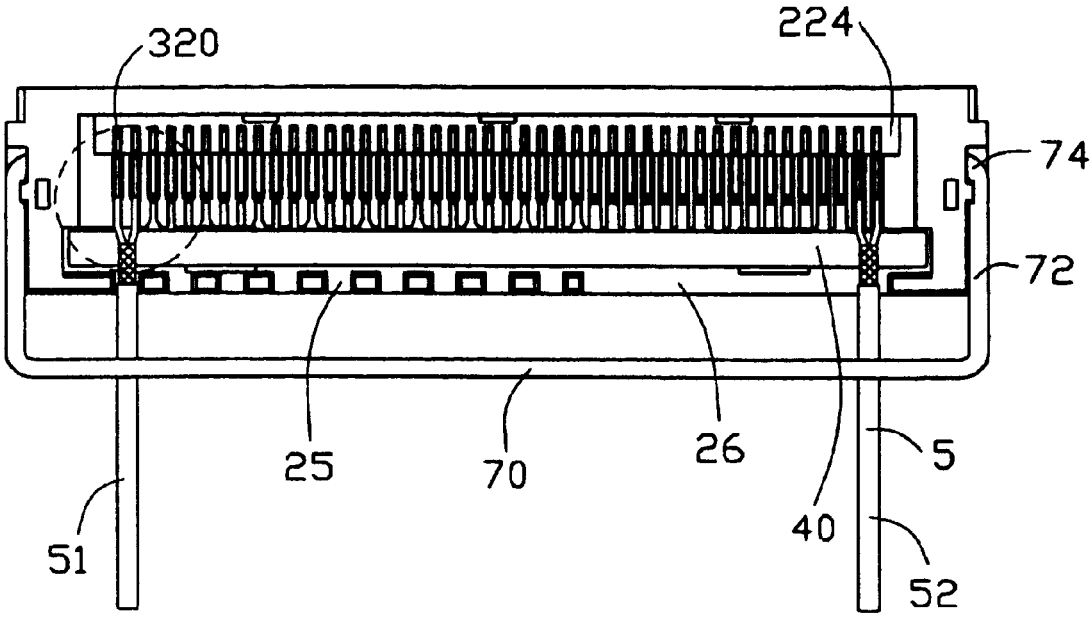
FIG. 7 is a cross-sectional view of the cable connector assembly of FIG. 3 taken along line 7—7.

Referring to FIGS. 1–2 in conjunction with FIGS. 6–7, the insulative housing 2 is substantially elongated and comprises a base 20 and a mating portion 21 protruding upwardly from the base 20. A pair of guiding posts 23 are respectively formed on opposite ends of the mating portion 21 for guiding proper insertion of a complementary connector. A receiving cavity 22 is recessed downwardly from an upper surface of the mating portion 21 for receiving a corresponding mating portion of the complementary connector. A plurality of grooves 25 is defined in a bottom of the base 20 and a channel 26 is also defined in the bottom of the base adjacent to the grooves 25. A pair of recesses 24 extend through a front side of the base 20 and a pair of slots 27 is respectively defined in the base 20 adjacent to opposite lateral ends of the base 20. A pair of protrusions 28 respectively laterally protrude from the lateral ends of the base 20. A receiving hole 29 is defined in each lateral end of the base 20 adjacent to a corresponding protrusion 28. The base 20 also defines a plurality of canals 222 (FIG. 6) in the bottom thereof. A cutout 224 (FIG. 7) is defined in the bottom of the base 20 and is recessed upwardly from the canals 222.

Referring to FIGS. 1–2, the grounding member 6 comprises a first grounding shield 60 and a second grounding shield 62. The first grounding shield 60 generally has a U-shaped configuration and comprises a U-shaped main body 600, a pair of first and second flanges 602, 606 extending vertically from bottom edges of the main body 600, and a vertical portion 607 extending downwardly from the second flange 606. The first flange 602 defines a pair of openings 604 therein and a pair of spring tabs 603 are formed between the pair of openings 604 and extend toward each other. A plurality of glossal portions 605 extends downwardly from the main body 600.

The second grounding shield 62 is substantially flat and comprises a plate portion 620. A pair of buckling portions 621 form on a rear portion of the plate portion 620 and extend vertically from opposite lateral edges of the plate portion 620. A bent edge 627 extends upwardly from a front edge of the plate portion 620. An L-shaped pressing portion 623 forms on a front portion of the plate portion 620 and bends vertically from the front edge of the plate portion 620. Each pressing portion 623 has a latch 624 extending rearwardly from an outer side thereof and a press tab 625 bending downwardly from a top surface thereof The plate portion 620 forms a plurality of spring arms 626 curved upwardly in the front portion thereof and a tab 628 bending upwardly from the rear portion thereof.

Particularly referring to FIG. 6, the conductive contact 3 is substantially U-shaped and comprises a pair of contacting portions 30 and a soldering portion 32 interconnecting the pair of contacting portions 30. The soldering portion 32 is formed with an extrusion 320 extending downwardly from a soldering surface 322 thereof.

Referring to FIGS. 1–2, the grounding bar 4 comprises a first grounding bar 40 and a second grounding bar 42. The first grounding bar 40 is a flat plate. The second grounding bar 42 comprises a body portion 420, a pair of strips 422 extending rearwardly from opposite sides of the body portion 420, and a plurality of grounding fingers 424 extending rearwardly from the body portion 420.

Figure 8:
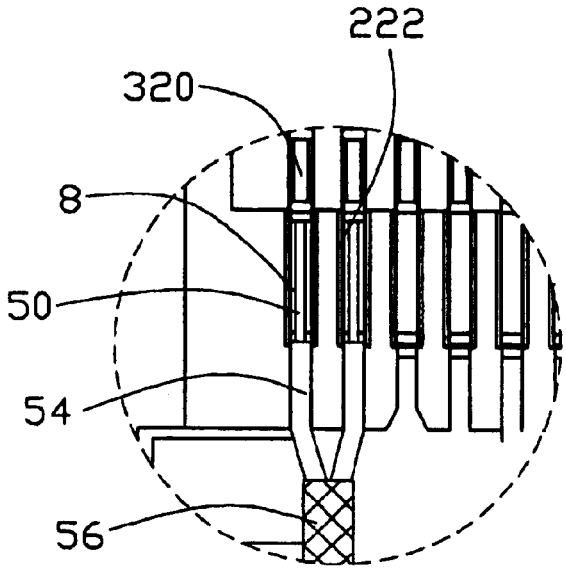
FIG. 8 is an enlarged view of a circled portion of FIG. 7.

Referring to FIGS. 1–2 in conjunction with FIGS. 6–8, the cable 5 comprises a group of first wires 51 for signal transmission and a group of second wires 52 for power transmission. Each wire 51, 52 comprises a pair of conductors 50 arranged as a differential pair, an insulative layer 54 enclosing the conductors 50, a metal braiding 56 enclosing the insulative layer 54 and an outer jacket (not labeled) enclosing the metal braiding 56.

Referring to FIGS. 1–2, the pulling member 7 comprises a pulling section 70, a pair of arms 72 extending rearwardly from opposite ends of the pulling section 70, and a pair of engaging sections 74 respectively extending vertically from corresponding arms 72 and extending toward each other.

Referring to FIGS. 1–4 in conjunction with FIGS. 5–8, in assembly, the conductive contacts 3 are firstly assembled to the insulative housing 2. The contacting portions 30 of each conductive contact 3 are respectively received in corresponding passages 220 defined in opposite inner surfaces of the receiving cavity 22. The soldering portion 32 is received in the canal 222 of the base 20 with the extrusion 320 thereof exposed in the cutout 224. The first grounding bar 40 is positioned in the bottom of the base 20. The conductors 50 of the first and the second wires 51, 52 are respectively contacting with the soldering surface 322 of the soldering portions 32 and received in the canals 222. Free ends of the conductors 50 respectively abut against the extrusions 320 of the soldering portions 32. The second grounding bar 42 is put on the wires 51, 52 and the metal braidings 56 of the wires 51, 52 are electrically connecting with the first and the second grounding bars 40, 42. The grounding fingers 424 of the second grounding bar 42 are inserted in selected canals 222 to be soldered with respective grounding contacts (not labeled). In addition, a plurality of solder slugs 8 is provided between the soldering portions 32 of the contacts 3 and the conductors 50 of the first and the second wires 51, 52. When soldering the wires 51, 52 to the conductive contacts 3, heat is supplied to the extrusions 320 of the conductive contacts 3, and is conducted to other parts of the soldering portions 32 to melt the solder slugs 8 to solder the wires 51, 52 and the conductive contacts 3 together.

The first grounding shield 60 is assembled to the insulative housing 2 in an. up-to-down direction. The main body 600 of the first grounding shield 60 encloses the mating portion 21 of the housing 2 with the first and the second flanges 602, 606 respectively located on the base 20. The pair of spring tabs 603 are respectively received in the recesses 24 of the housing 2 and electrically connect with the first grounding bar 40. The vertical portion 607 covers a rear side of the base 20 with the glossal portions 605 received in the base 20. The second grounding shield 62 is assembled to the insulative housing 2 in a front-to-rear direction. The plate portion 620 of the second grounding shield 62 encloses the bottom of the base 20 with the spring arms 626 electrically connected with the second grounding bar 42. The pressing portions 623 press on the first flange 602 of the first grounding shield 60 and the latches 624 are securely received in the slots 27 of the housing 2 with the press tab 625 received in the opening 604 of the first grounding shield 60 and abutting against the base 20. The buckling portions 621 respectively buckle to the protrusions 28 of the housing 2 and the tab 628 presses against the bottom of the base 20. Thus, the first and the second grounding shields 60, 62, and the wires 51, 52 form a grounding path therebetween.

The pulling member 7 is assembled to the insulative housing 2 with the pair of engaging sections 74 respectively received in the receiving holes 29 of the insulative housing 2.

It is noted that since the extrusions 320 are exposed in the cutout 224 and beyond the canals 222, it is convenient to heat the extrusions 320 directly to solder the contacts 3 with the wires 51, 52.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro coaxial cable connector assembly, comprising:

an insulative housing comprising a mating portion defining a receiving cavity opening in a first direction, a base perpendicular to the mating portion and defining a plurality of canals;

a plurality of conductive contacts each comprising a contacting portion received in the mating portion of the insulative housing and a soldering portion received in a corresponding canal, the soldering portion forming an extrusion exposed beyond the canal;

a plurality of wires assembled to the base, each wire comprising a conductors extending into a corresponding canal in a second direction perpendicular to said first direction and a metal braiding surrounding the conductor;

a plurality of solder slugs each received in a corresponding canal and located between the soldering portion of the conductive contact and the conductor of the wire, the solder plugs melting upon heating the extrusions of the soldering portions to solder the conductive contacts with the conductors together; and a grounding member comprising a first grounding shield assembled to the mating portion in said first direction and a second grounding shield assembled to the base in said second direction, the first and the second grounding shields being electrically connected with each other and electrically connecting with the metal braidings of the wires.

2. The cable connector assembly as claimed in claim 1, wherein the base defines a cutout communicating with the canals and recessed in said first direction, and wherein the extrusions of the soldering portions are exposed in the cutout.

3. The cable connector assembly as claimed in claim 1, further comprising a pulling member assembled to the base.

4. The cable connector assembly as claimed in claim 3, wherein the base defines a pair of receiving holes in opposite lateral sides thereof, and wherein the pulling member comprises a pair of engaging sections respectively received in the receiving holes.

5. The cable connector assembly as claimed in claim 4, wherein the pulling member comprises a pulling section parallel to the engaging sections and a pair of arms interconnecting the pulling section and the engaging sections.

6. The cable connector assembly as claimed in claim 1, wherein the first grounding shield is U-shaped and the second grounding shield is of a flat plate.

7. The cable connector assembly as claimed in claim 1, wherein the first grounding shield comprises a first flange located on the base, and wherein the second grounding shield comprises a pressing portion electrically connecting with the first flange.

8. The cable connector assembly as claimed in claim 7, wherein the base comprises a slot, and wherein the pressing portion of the second grounding shield has a latch securely received in the slot.

9. The cable connector assembly as claimed in claim 1, wherein the base forms a protrusion, and wherein the second grounding shield forms a buckling portion engaging with the protrusion to secure the second grounding shield to the insulative housing.

10. The cable connector assembly as claimed in claim 1, wherein the base defines a recess, and wherein the first shielding shield comprises a spring tab received in the recess and electrically connecting with the metal braiding of the wires.

11. The cable connector assembly as claimed in claim 1, wherein the wire comprises a pair of conductors arranged as a differential pair.

12. The cable connector assembly as claimed in claim 1, wherein the wires are grouped into power transmitting wires and signal transmitting wires, and wherein the base defines a plurality of grooves receiving the signal transmitting wires and a channel beside the grooves receiving the power transmitting wires.

13. The cable connector assembly as claimed in claim 1, wherein the conductive contact is U-shaped.

14. A cable connector assembly comprising:

a metallic shell;

an insulative housing received in the shell, said housing including a mating port defining a receiving cavity, and a base being far away from the mating port and defining a plurality of canals extending along a first direction, said canals communicating with an exterior in a second direction perpendicular to said first direction before said shell and said housing are assembled together;

a plurality of contacts disposed in the housing, each of said contacts defining a solder portion located around and aligned with the corresponding canal in the second direction, a protrusion formed on the solder portion extending toward the exterior along said second direction; and a plurality of wires connected to the corresponding contacts, respectively, each of said wires including an inner conductor received in the corresponding canal and in alignment with the solder portion of the corresponding contact in said second direction; wherein a solder slug is provided between every pair of the solder portion and the inner conductor under a condition that said slug is melted to combine said pair of solder portion and the inner conductor by heat which is closely applied to the protrusion of the corresponding contact.

15. The assembly as claimed in claim 14, wherein the protrusion of the contact is aligned with the corresponding inner conductor of the wire along the first direction.

* * * * *